United States Patent [19]

Tanaka et al.

[11] Patent Number: 4,608,946

[45] Date of Patent: Sep. 2, 1986

[54] PORTABLE ENGINE-GENERATOR SET

[75] Inventors: Yoshio Tanaka, Fujimi; Yasuo Sugimoto, Asaka, both of Japan

[73] Assignee: Honda Giken Kogyo Kabushiki Kaisha, Tokyo, Japan

[21] Appl. No.: 609,388

[22] Filed: May 11, 1984

[30] Foreign Application Priority Data

May 11, 1983 [JP] Japan ..... 58-70361[U]
May 20, 1983 [JP] Japan ..... 58-75781[U]

[51] Int. Cl.[4] ..... F02B 63/04

[52] U.S. Cl. ..... 123/2; 290/1 A; 290/1 B; 60/721

[58] Field of Search ..... 60/721, 669; 123/2; 290/1 A, 1 B, 1 R

[56] References Cited

U.S. PATENT DOCUMENTS

| | | | |
|---|---|---|---|
| 2,355,208 | 8/1944 | Devol et al. | 290/1 |
| 4,060,985 | 12/1977 | Fukushima | 60/319 |
| 4,098,077 | 7/1978 | Edmaier et al. | 60/272 |
| 4,495,901 | 1/1985 | Nannini et al. | 290/1 B |

FOREIGN PATENT DOCUMENTS

| | | | |
|---|---|---|---|
| 1249585 | 9/1967 | Fed. Rep. of Germany . | |
| 1476538 | 9/1970 | Fed. Rep. of Germany . | |
| 2300397 | 7/1974 | Fed. Rep. of Germany | 123/198 E |
| 2242742 | 3/1975 | France . | |
| 57-49732 | 10/1982 | Japan . | |
| 1263979 | 2/1972 | United Kingdom . | |
| 1474538 | 5/1977 | United Kingdom . | |
| 2092666 | 8/1982 | United Kingdom . | |

*Primary Examiner*—Allen M. Ostrager
*Attorney, Agent, or Firm*—Armstrong, Nikaido, Marmelstein & Kubovcik

[57] ABSTRACT

A portable engine-generator set is provide, which includes a soundproof cover defining an internal space for housing the components of the engine-generator set. The internal space comprises an intake compartment, a heat source compartment and an exhaust compartment. The heat source compartment comprises first and second sub-compartments which form independent cooling wind passages, each of the sub-compartments having an intake port in communication with the intake compartment. The exhaust compartment has an exhaust port in communication with the atmosphere, and intake ports in communication with the first and second sub-compartments such that air flow from the first and second sub-compartments are combined in the exhaust compartment. The engine and muffler of the engine are positioned in the second sub-compartment and the exhaust gas from the muffler flows into the exhaust compartment and is combined with the flow from the first and second sub-compartments, thereby rapidly cooling the exhaust gas and reducing the noise therefrom. The exhaust compartment includes sound absorbing material on the walls thereof to form a silencer box.

3 Claims, 5 Drawing Figures

PORTABLE ENGINE-GENERATOR SET

BACKGROUND OF THE INVENTION

1. Field of the Invention

The present invention relates to an improvement in a soundproofing structure for improving the cooling and soundproofing effects of a portable engine-generator set covered in its entirety with a soundproofing cover.

2. Description of Prior Art

Prior art portable engine-generator sets of relatively small size are generally covered in their entirety with a soundproofing cover with a view to soundproofing against noises and/or protecting its components. However, this type of engine-generator set is accompanied by a problem in that it is excellent in soundproofing effect, but is radiation characteristics are deteriorated to a substantial extent. In order to improve the radiation of the engine-generator set of this type, the shaft of the engine or the generator is usually equipped with a cooling fan to supply cooling air from one side to the other of the engine-generator set. It is, however, difficult to sufficiently satisfy both the soundproofing effect and the cooling effect. Further, the soundproofing cover merely shields the body of the set, and the exhaust port of the muffler has to directed or exposed to the outside so as to smoothen its discharge. The soundproofing structure thus provides only the shielding action of the soundproofing cover. As a result, a sufficient soundproofing effect cannot be obtained for the exhaust sound of the muffler.

SUMMARY OF THE INVENTION

It is the primary object of the present invention to provide, an engine-generator set with a soundproof cover, which surrounds the engine-generator set and whch has an internal structure for improving both soundproofing and cooling, for the engine-generator set.

It is another object of the present invention to provide a portable engine-generator set, in which the internal space of the soundproof cover is divided into a plurality of compartments each of the compartments containing particular components of the engine-generator, wherein each compartment provides air flow to achieve cooling for the components in that compartment.

It is still a further object of the present objection to combine the flow of cooling air from the various compartments with the exhaust gas from the engine, in order to rapidly cool the exhaust gas and to reduce the noise generated thereby.

The present invention is directed to a portable engine-generator set, including a soundproof cover defining an internal space, for housing the components of the engine-generator set. The internal space comprises an intake compartment which inlcudes an intake port for drawing atmospheric air into the cover. A heat source compartment is in communication with the intake compartment and comprises first and second sub-compartments the first and second sub-compartments forming independent cooling wind air passages. Each of the sub-compartments has an air intake port in communication with the intake compartment. An exhaust compartment is in communication with the heat source compartment, the exhaust compartment having an exhaust port in communication with the atmosphere and an intake port in communication with the first and second sub-compartments. The generator of the engine-generator set is positioned in the first sub-compartment and the engine and muffler are positioned in the second compartment. The exhaust gas from the muffler is discharged into the exhaust compartment such that it is mixed with the flow from the first and second sub-compartments to thereby provide rapid cooling of the exhaust gas and reduce the noise generated therefrom.

BRIEF DESCRIPTION OF THE DRAWINGS

Detailed Description of the Preferred Embodiment

Figure 1:
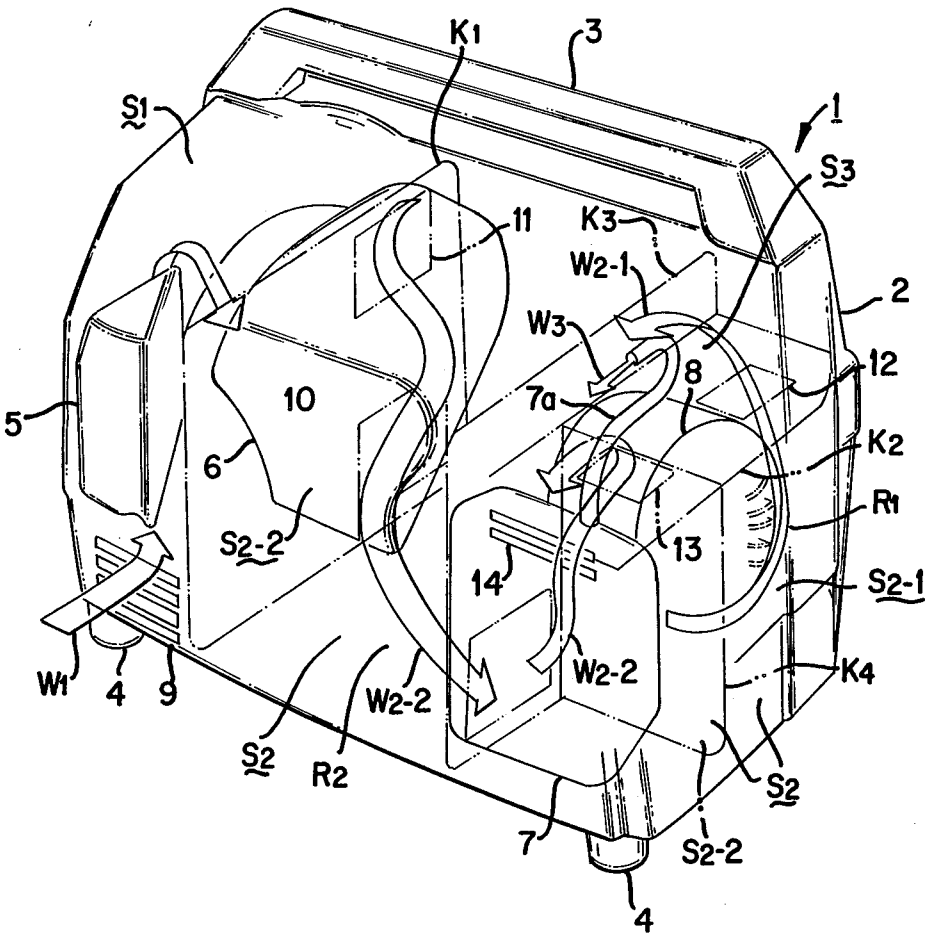

FIG. 1 is a view for explaining the principle of the portable engine-generator set according to the present invention.

Figure 2:
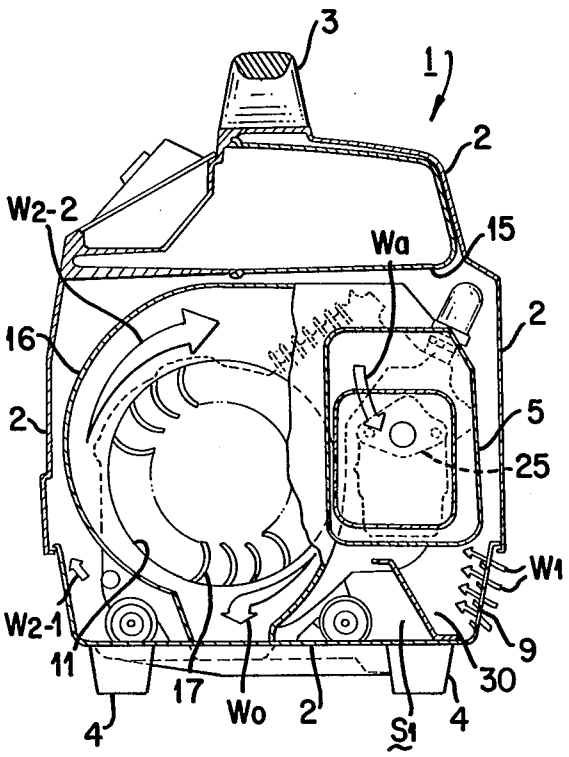

FIG. 2 is a righthand sectional view showing a portable engine-generator set of the present invention.

Figure 3:
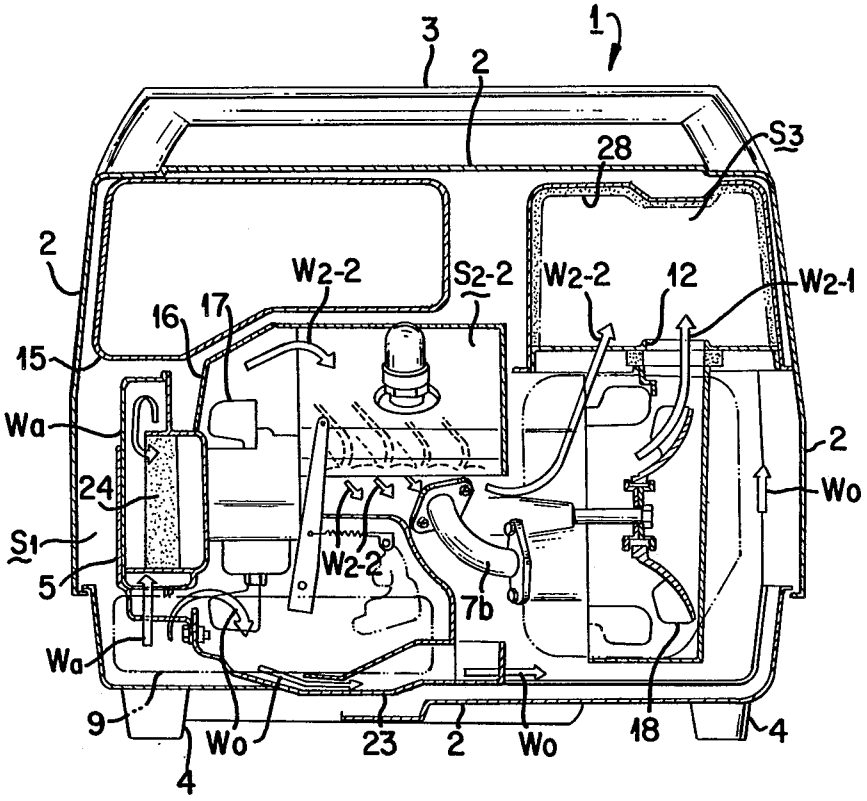

FIG. 3 is a sectional rear elevation thereof.

Figure 4:
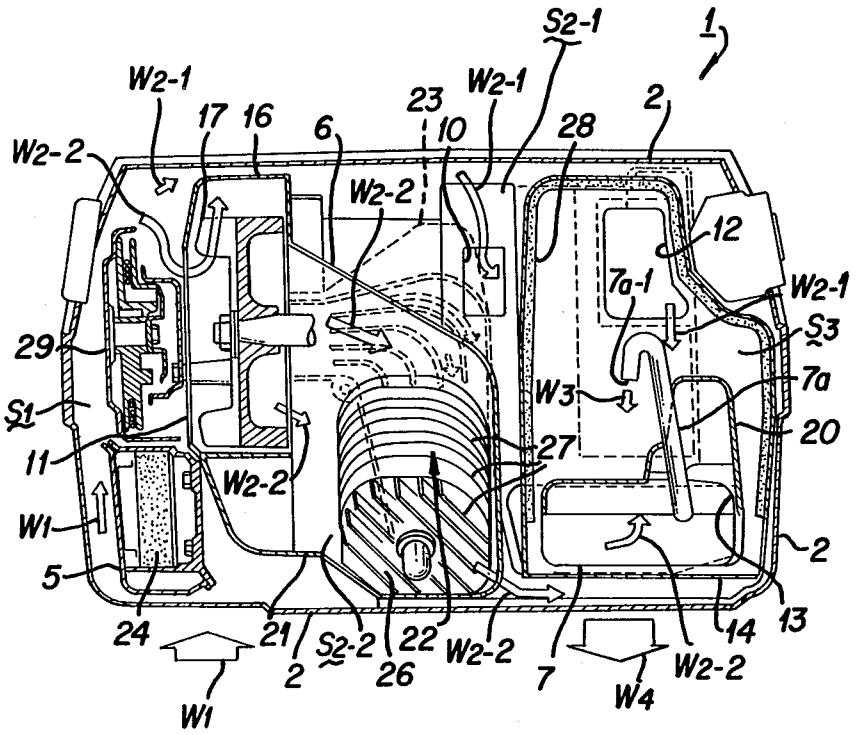

FIG. 4 is a sectional top plan view thereof.

Figure 5:
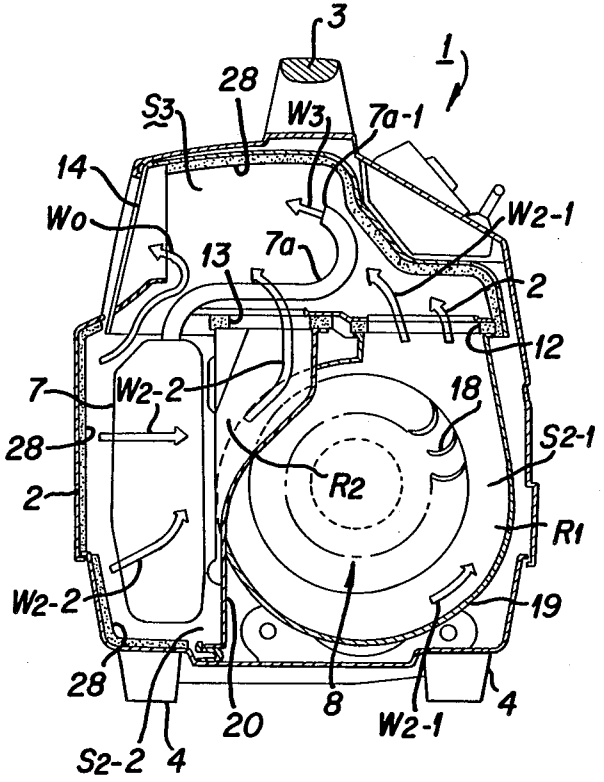

FIG. 5 is a lefthand sectional view thereof.

DETAILED DESCRIPTION OF THE PREFERRED EMBODIMENT

Referring to FIG. 1, the portable engine-generator set 1 is covered in its entirety with a soundproofing cover 2 and has a handle 3 at its top and legs 4 at its bottom. The engine-generator set is equipped with an air cleaner 5, an engine covered with the shroud 6, a muffler 7 and a generator 8. Motor-generator sets comprising the above components are well known and in such motor-generator sets the engine drives the generator 8 which generates electric power.

In the present invention, the internal space of the engine-generator set 1 is partitioned by means of partitions $K_1$, $K_2$ and $K_3$, for example, into an intake compartments $S_1$ at one side, which houses the air cleaner 5, a carburetor, etc.; a heat source compartment $S_2$, at a middle portion, which houses the engine, the muffler 7, the generator 8, etc.; and exhaust compartment $S_3$ at the other side, i.e., at the righthand upper portion in FIG. 1. The heat source chamber $S_2$ is further partitioned by means of partitions $K_3$ and $K_4$ and the shroud 6 into a frist sub-compartment $S_{2\text{-}1}$ housing the generator 8 and a second sub-compartment $S_{2\text{-}2}$ housing the engine, the muffler 7 and other heat source components.

The intake chamber $S_1$ is formed at its lower portion with an intake port 9 for drawing atmospheric air therethrough, i.e., for inhaling or sucking cooling wind or air $W_1$, as indicated by the arrows, into the intake compartments $S_1$. Moreover, the air cleaner 5 and the carburetor (not shown in FIG. 1), which are arranged in the intake compartment $S_1$, are positioned at the middle of the cooling wind passage which extends from the intake part 9 to front communication parts 10 and 11. The intake compartment $S_1$ and the first and second sub-compartments $S_{2\text{-}1}$ and $S_{2\text{-}2}$ are formed with the front communication ports 10 and 11 which provide communication therebetween. The exhaust compartment $S_3$forms a silencer box and the first and second sub-compartments $S_{2\text{-}1}$ and $S_{2\text{-}2}$ are formed with rear communication ports 12 and 13 which provide communication therebetween.

As a result, the cooling wind $W_1$, drawn through the intake port 9, first cools and the air cleaner 5 and the carburetor, and a portion then flows through a first cooling wind passage or path $R_1$, which is defined by the front communication port 10, the first sub-compartment $S_{2\text{-}1}$, the rear communication port 12 and the exhaust compartment $S_3$, to cool the generator 8, as indicated at $W_{2-1}$, until it is guided into the exhaust compartment $S_3$.

Another portion of the cooling wind $W_1$ flows through a second cooling wind passage or path $R_2$, which is defined by the communication port 11, the shroud 6, the second sub-compartment $S_{2-2}$, the communication port 13 and the exhaust compartment $S_3$, to cool the engine and the muffler 7, as indicated at $W_{2-2}$, until it is guided into the exhaust compartment $S_3$.

Exhaust gas $W_3$ is introduced into the exhaust compartment $S_3$ by positioning this compartment $S_3$ to face the trailing exhaust port $7_{a-1}$ of the rear exhaust pipe 7*a* of the muffler 7. As a result, the cooling winds $W_{2-1}$ and $W_{2-2}$ and the exhaust gas $W_3$ are all introduced into the exhaust compartment $S_3$ and are then discharged to the outside from an exhaust port 14 which is formed downstream in the exhaust compartment $S_3$. That exhaust port 14 may be opened in the same direction as flow through the exhaust chamber, i.e., in a common side face.

As is apparent from the principle described in the above, according to the present invention, the internal space is first partitioned into independent compartments $S_1$, $S_{2-1}$, $S_{2-2}$ and $S_3$, and the cooling winds flow through the respective compartments such that the suction and discharge are through the openings formed in the compartments.

Referring to FIGS. 2–5, the intake compartment $S_1$ is defined by a soundproofing cover 2, a fuel tank 15, and a fan cover 16. The soundproofing cover 2 is formed at its lower portion with the intake port 9 by forming a plurality of slots therein. The cooling wind passage is formed in the cover 2, and leads to the front communication ports 10 and 11 communicating with the heat source compartment $S_2$, by positioning a wind deflector 30. The formation of the intake port 9 in the lower portion of the soundproofing cover 2 is intended to draw cold atmospheric air which eliminates as much as possible the influence from the hot air and its radiation which is discharged from the exhaust port 14.

The air cleaner 5 and the carburetor 25 are arranged in the intake compartment $S_1$ and are in the middle of the cooling wind path leading from the intake port 9 to the front communication ports 10 and 11. The air cleaner 5 draws intake air $W_a$ therefor from an air intake portion $5_a$ which is disposed at as remote a position as possible from the intake port 9. The wind deflector 30 has a shape and position which effects cooling of the air cleaner 5 and the carburetor 25 with the cooling wind $W_1$ which is drawn from the intake port 9. The cooling wind $W_1$ is drawn by the action of an engine cooling fan 17 and a generator cooling fan 18.

In the heat source compartments $S_2$, the first sub-compartment $S_{2-1}$ is defined by the soundproofing cover 2, the frame itself othe generator 8, a fan cover 19, and a muffler separator 20. One portion of the cooling wind $W_1$ becomes the cooling wind $W_{2-1}$ which cools the generator 8 and then flows into the exhaust compartment $S_3$ from the communication port 12 formed at the lower portion of the compartment $S_3$. This blowing operation is effected by the rotation of the generator cooling fan 18.

In the heat source compartment $S_2$, moreover, the second sub-compartment $S_{2-2}$ is partially defined by the fan cover 16, the shroud 6 leading from the cover 16, and a top cover 21 to accommodate an engine 22. The remaining portion of the second sub-compartment $S_{2-2}$ is defined by the muffler separator 20 leading from the shroud 6, and the soundproofing cover 2 to accommodate the muffler 7. Another portion of the cooling wind $W_1$ becomes the cooling $W_{2-2}$ which flows through the second sub-compartment $S_{2-2}$ formed into a duct shape. The cooling wind $W_{2-2}$ is drawn from the communication port 11, which is formed at the side of the fan cover 16 and is open to face the intake compartment $S_1$. The cooling wind $W_{2-2}$ cools the engine 22 and the muffler 7 until it flows into the exhaust compartment $S_3$ through the communication port 13 formed in the lower portion of said compartment $S_3$.

The respective compartments $S_1$, $S_{2-1}$, $S_{2-2}$ and $S_3$ are partitioned from one another, and as a result, the cooling wind $W_1$ and the cooling winds $W_{2-1}$ ns $W_{2-2}$ are isolated from one another to provide independent cooling winds, which are finally mixed in the exhaust compartment $S_3$. The communication port 10 provides communication between the intake compartment $S_1$ and the first sub-compartment $S_{2-1}$ of the heat source compartment $S_2$.

In addition to the fundamental construction thus far described, the cooling wind $W_a$, which is a portion of the cooling wind $W_1$, is supplied to the air cleaner 5 to provide the air cleaner intake air. Within the heat source compartment $S_{2-2}$, a portion of the cooling air $W_{2-2}$ is guided by an under guide 23 to cool the oil pan until it merges again with the cooling wind $W_{2-2}$ to flow into the exhaust compartment $S_3$.

According to the present invention, the rear exhaust pipe 7*a* of the muffler 7 has its trailing exhaust port $7_{a-1}$ in communication with the exhaust compartment $S_3$ by protruding at its rear end portion into the side portion of the exhaust compartment $S_3$. Moreover, this exhaust compartment $S_3$ is formed with the exhaust port 14 for discharging therethrough a mixed gas flow to the outside. The mixed gas flow is composed of the cooling wind and the exhaust gas which have combined within the exhaust compartment $S_3$. The exhaust port 14 and the intake port 9 are formed in the same side face of the cover 2, taking into consideration the convection of the atmospheric air and the prevention of dust from being stirred up. Thus the port 9 is positioned in the upper portion of the body.

The trailing exhaust port $7_{a-1}$ is directed to the exhaust port 14 so that the discharge of the exhaust gas $W_3$ may be effected. As a result, the exhaust compartment $S_3$ gathers the cooling winds $W_{2-1}$ and $W_{2-2}$ and the exhaust gas $W_3$ so that a mixed wind $W_4$ is discharged from the exhaust port 14 to the outside.

Element 24 is fitted in the air cleaner 5 and the carburetor 25 connects the air cleaner 5 and the engine 22. A front exhaust pipe 7*b* connects the engine 22 and the muffler 7. The engine cylinder 26 is formed with a plurality of cooling fins 27, and a recoil starter 29 is provided.

A glass wool material or other sound absorbing material 28 is applied to various portions of the structure especially, to the inner walls of the exhaust compartment $S_3$, so that the exhaust compartment $S_3$ may be formed into a silencer box to enhance the silencing effect.

The present invention is not limited to the embodiment thus far described, but the shapes of the respective portions, especially, the shapes of the element partitioning the respective compartments $S_1$, $S_{2-1}$, $S_{2-2}$ and $S_3$ can be modified and can be applied to any engine-generator set.

As is now apparent from the description thus far made, according to the soundproofing and cooling structure of the portable engine-generator of the present invention, the internal space is partitioned into an intake compartment, a heat source compartment and an exhaust compartment, and the heat source compartment is further partitioned into a first sub-compartment accommodating the generator and a second sub-compartment accommodating the other heat source components. The cooling winds which pass through the respective compartments, flow through the independent cooling wind passages so that sound absorbing treatment of the intake sound, engine sound and exhaust sound can be effected in the respective compartments and the most proper and feasible sound absorbing treatment can be effected to correspond to the respective compartments, i.e., the properties of the sounds generated in the respective compartments. Moreover, the respective cooling winds are finally collected in the exhaust compartment so that the silencing effect can be further improved by the function of an expansion chamber.

The partitioned respective compartments are confined and thereby smoothen the discharge wind and improve the discharge the wind and improve the discharge efficiencies thereof. Further, the cooling winds have their cooling efficiencies per unit flow rates improved while having little circulation because they are forced to contact the heat source components, thus providing the soundproofing and cooling structure of the portable engine-generator set with a variety of advantages.

Furthermore, the internal space is partitioned into at least the two cooling wind paths, i.e., one for cooling the generator and the other for cooling the heat source components other than the generator, and there is formed the exhaust compartment which is a silencer box having communication with the terminal openings of the respective cooling wind paths and the exhaust port of the muffler so that the exhaust gas is guided into the exhaust compartment and is discharged together with the cooling wind to the outside. As a result, the exhaust gas is rapidly cooled and diffused, in the exhaust compartment, with the cooling wind having a considerably lower temperature than that of the exhaust gas, so that the volume and flow velocity of the exhaust gas is lowered by the cooling operation. Consequently, the exhaust sound of the muffler can be further reduced.

The heat source components are accommodated in the heat source compartments, which are partitioned independently of one another, so that they form the independent cooling wind passages. As a result, the most appropriate soundproofing treatments can be effected for the properties of the respectively generated sounds. At the same time, the respective cooling winds and the exhaust gas can be silenced within the exhaust compartment. As a result, the soundproofing effect can be improved, and the soundproofing treatment can be facilitated.

Within the exhaust compartment, the cooling winds, which come from the plural cooling wind passages having different blowing properties, and the exhaust gas are mixed. As a result, the temperature can be made uniform, and the pulsations of the exhaust gas can be reduced. Thus, it is possible to provide a soundproofing structure for the portable engine-generator set, which has various advantages including a cooling effect and accordingly the handling can be improved by the reduction in the heat conduction to the covers.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A portable engine-generator set including a soundproof cover defining an internal space therewithin for housing components of said engine-generator set, and a plurality of partitions provided in said internal space and, in cooperation with said cover and a shroud covering an engine of said engine-generator set, partitioning said internal space into (a) an intake compartment, said intake compartment including intake port means for drawing atmospheric air into said cover;

(b) a heat source compartment in communication with said intake compartment, said heat source compartment comprising first and second subcompartments each forming independent cooling air passages and each having an air intake port in communication with said intake compartment, a generator of said engine-generator set being positioned within said first subcompartment, and said engine and a muffler of said engine-generator set being positioned within said second subcompartment; and (c) an exhaust compartment in communication with said heat source compartment, said exhaust compartment having an exhaust port means in communication with the atmosphere, and having intake ports in communication with said first and second subcompartments of said heat source compartment whereby air flow from said first and second subcompartments is combined in said exhaust compartment, exhaust gas from said muffler being discharged into said exhaust compartment, and said exhaust compartment having sound absorbing material provided on at least a portion of defining walls thereof such that said exhaust compartment forms a silencer box;

wherein said exhaust gas discharged from said muffler into said exhaust compartment is mixed therein with said air flow from said first and second subcompartments.

2. A portable engine-generator set at set forth in claim 1 wherein an air cleaner and carburetor of said engine-generator set are positioned in said intake compartment.

3. A portable engine-generator set as set forth in claim 1 wherein said intake port means and said exhaust port means are formed in a same side wall of said cover, said exhaust port means being positioned higher than said intake port means.

* * * * *